US011524838B2

(12) United States Patent
Igarashi et al.

(10) Patent No.: US 11,524,838 B2
(45) Date of Patent: Dec. 13, 2022

(54) METHOD FOR DISCHARGING GRANULAR POWDER BROUGHT INTO FIXED STATE INSIDE HOLLOW STRUCTURE

(71) Applicant: PLANT BASE Co., Ltd., Kurashiki (JP)

(72) Inventors: Ryota Igarashi, Kurashiki (JP); Daigo Igarashi, Kurashiki (JP)

(73) Assignee: PLANT BASE Co., Ltd., Kurashiki (JP)

( * ) Notice: Subject to any disclaimer, the term of this patent is extended or adjusted under 35 U.S.C. 154(b) by 679 days.

(21) Appl. No.: 16/605,345

(22) PCT Filed: Jan. 11, 2019

(86) PCT No.: PCT/JP2019/000749
§ 371 (c)(1),
(2) Date: Oct. 15, 2019

(87) PCT Pub. No.: WO2019/193803
PCT Pub. Date: Oct. 10, 2019

(65) Prior Publication Data

US 2021/0122563 A1 Apr. 29, 2021

(30) Foreign Application Priority Data

Apr. 2, 2018 (JP) ..... JP2018-70868

(51) Int. Cl.
*B65D 88/54* (2006.01)
*A62B 35/00* (2006.01)
(Continued)

(52) U.S. Cl.
CPC ..... *B65D 88/54* (2013.01); *A62B 35/00* (2013.01); *B65D 88/66* (2013.01); *E04G 3/246* (2013.01); *E04G 3/28* (2013.01); *E04G 2003/286* (2013.01)

(58) Field of Classification Search
CPC ..... B65D 88/54; B65D 88/66; B65D 88/68; B65D 88/72; E04G 3/28; E04G 3/24; E04G 3/246; E04G 2003/286
See application file for complete search history.

(56) References Cited

U.S. PATENT DOCUMENTS 3,302,976 A * 2/1967 Louisa ..... C21B 7/06 173/52
3,370,888 A * 2/1968 Skendrovic ..... F27D 1/1694 173/196
(Continued)

FOREIGN PATENT DOCUMENTS

JP 54-107141 A 8/1979
JP 4843327 B2 8/2007
(Continued)

OTHER PUBLICATIONS

English language International Search Report for PCT/JP2019/000749, dated Mar. 26, 2019 (1 page).
(Continued)

*Primary Examiner* — Colleen M Chavchavadze
(74) *Attorney, Agent, or Firm* — Flynn Thiel, P.C.

(57) ABSTRACT

A rack rail is suspended into a silo from an opening formed in a ceiling portion of the silo and a lifting body is lowered into the silo along the rack rail from the opening. A work scaffold is built on the lifting body using a part carried into the silo from the opening, a worker connected to the work scaffold with a safety belt pokes and breaks down a granular powder in a state where a discharge port of a silo bottom portion is closed, the poked and broken down granular powder drops to a rat hole (or boring hole), the worker connected to the work scaffold with the safety belt adds a rack rail in a state where the rat hole is blocked with the granular powder, the discharge port is opened to discharge
(Continued)

the granular powder stored in the passage, and then the work scaffold is lowered to the added rack rail.

5 Claims, 21 Drawing Sheets

(51) Int. Cl.

| | |
|---|---|
| ***E04G 3/28*** | (2006.01) |
| ***B65D 88/66*** | (2006.01) |
| ***E04G 3/24*** | (2006.01) |

(56) References Cited

U.S. PATENT DOCUMENTS

| | | | | | |
|---|---|---|---|---|---|
| 3,436,120 | A | * | 4/1969 | Armstrong | E04G 23/08 182/128 |
| 4,120,378 | A | * | 10/1978 | Mills | E04G 3/24 182/128 |
| 4,657,402 | A | * | 4/1987 | Dupuis | B65D 88/68 366/349 |
| 4,942,982 | A | * | 7/1990 | Hartwigsen | B08B 7/02 222/404 |
| 5,074,478 | A | * | 12/1991 | Fujiwara | B65D 88/66 241/101.1 |
| 5,301,770 | A | * | 4/1994 | Regan | E04G 3/30 182/128 |
| 10,233,065 | B2 | * | 3/2019 | Jackson | B66F 11/046 |
| 2013/0048426 | A1 | | 2/2013 | Ekdahl | |

FOREIGN PATENT DOCUMENTS

| | | | | |
|---|---|---|---|---|
| JP | 5823461 | B2 | 3/2015 | |
| KR | 200486287 | Y1 * | 4/2018 | |
| KR | 20210090083 | A * | 7/2021 | |
| WO | WO-2006097505 | A1 * | 9/2006 | E04F 11/04 |

OTHER PUBLICATIONS

Japanese language International Search Report for PCT/JP2019/000749, dated Mar. 26, 2019 (2 pages).

* cited by examiner

METHOD FOR DISCHARGING GRANULAR POWDER BROUGHT INTO FIXED STATE INSIDE HOLLOW STRUCTURE

TECHNICAL FIELD

The present invention relates to a method for, when a granular powder stored in a hollow structure, such as a silo, a tank, a bottle, and a country elevator, is brought into a fixed state and cannot be discharged from a discharge port of a bottom portion of the hollow structure, breaking down the granular powder in the fixed state, and then discharging the same from the discharge port.

BACKGROUND ART

In hollow structures, such as a silo, a tank, a bottle, and a country elevator, a granular powder, such as grains and feeds, is stored. Hereinafter, the silo is described but the same applies to the hollow structures, such as a tank, a bottle, and a country elevator. Since the granular powder, such as grains and feeds, stored in the silo is pressed against the inner surface of the silo to be brought into a consolidated state due to the total weight of the stored granular powder. Therefore, the granular powder is brought into a fixed state in the silo depending on various conditions and cannot be appropriately discharged from a discharge port provided in a silo bottom portion in some cases.

For example, when the granular powder stored in the silo has a relatively soft property, the granular powder is pressed against the inner surface of the silo due to the total weight of the granular powder itself to be brought into a consolidated state and fixed depending on the moisture content of the granular powder, the environmental factors, such as weather (humidities and temperatures), when taking the granular powder into/out of the silo, and the like, and then the granular powder is further pressed thereagainst to be laminated thereon. When such lamination is repeated, so that the layer thickness increases, the granular powder stored in the silo is brought into a state of being fixed to the inner surface of the silo, except a long and narrow space portion (rat hole) along the vertical direction in a central portion.

When the rat hole is formed, a new granular powder charged into the silo from an opening of a ceiling portion of the silo is immediately discharged from the discharge port of the silo bottom portion through the rat hole (funnel flow), and thus the granular powder brought into the fixed state on the inner surface of the silo is not discharged. More specifically, the first-in first-out of the granular powder cannot be performed, so that the granular powder in the fixed state on the inner surface of the silo remains in the silo for a long period of time. The granular powder in the remaining state may deteriorate.

Moreover, the granular powder stored in the silo is brought into a consolidated state due to the total weight of the granular powder itself in an upper portion of the discharge port of the silo bottom portion formed in a funnel shape to be fixed in an arch shape (bridge) in some cases. When the bridge is formed, the upper portion of the discharge port of the silo bottom portion is brought into a state of being covered with the bridge. Therefore, the granular powder stored above relative to the bridge in the silo is not discharged from the discharge port of the silo bottom portion.

As a countermeasure when the granular powder in the silo is not appropriately discharged from the discharge port of the silo bottom portion by the rat hole or the bridge, the present inventors (applicant) have proposed a method including suspending a rack rail toward the bottom portion from the ceiling portion in the silo, building a work scaffold going up and down along the rack rail, poking and breaking down the granular powder fixed in the silo by a worker riding on the work scaffold, and then discharging the same from the discharge port of the silo bottom portion (see Patent Documents 1 and 2).

According to such a method, the worker poking and breaking down the granular powder in the fixed state in the silo can poke and break down the granular powder under the work scaffold in a state of riding on the work scaffold, and therefore a situation (collapse accident) where the worker is buried in the broken-down granular powder can be avoided.

PRIOR ART DOCUMENTS

Patent Documents

Patent document 1: Japanese Patent No. 5823461
Patent document 2: Japanese Patent No. 4843327

SUMMARY OF THE INVENTION

Problems to be Solved by the Invention

Patent Documents 1 and 2 disclose the rack rail suspended toward the bottom portion from the ceiling portion in the silo and the work scaffold going up and down along the rack rail as devices for poking and breaking down the granular powder brought into the fixed state in the silo but do not describe a procedure of installing the rack rail and the work scaffold and an order of operating the same. Therefore, a proposal for a building method with higher safety has been demanded.

It is an object of the present invention originated in consideration of the above-described situation to provide a method for discharging a granular powder brought into a fixed state inside a hollow structure, such as a silo, capable of more safely discharging the granular powder brought into the fixed state inside the hollow structure using the rack rail and the work scaffold described above, for example, from a discharge port of a bottom portion of the hollow structure.

Means for Solving the Problems

The present invention originated in order to achieve the above-described object provides a method for, when a granular powder stored inside a hollow structure is brought into a fixed state and cannot be discharged from a discharge port of a bottom portion of the hollow structure, breaking down the granular powder in the fixed state, and then discharging the granular powder from the discharge port includes suspending a rack rail of a predetermined length into an upper space in the hollow structure from an opening formed in a ceiling portion of the hollow structure, lowering a lifting body moving along the rack rail from the opening to the upper space in the hollow structure along the rack rail, building a work scaffold so as to project in the horizontal direction on the lifting body in the upper space in the hollow structure using a part carried into the hollow structure from the opening, poking and breaking down the granular powder in the fixed state under the work scaffold by a worker connected to the work scaffold with a safety belt in a state where the discharge port of the bottom portion of the hollow structure is closed, dropping the poked and broken down granular powder to a passage formed in the granular powder in the fixed state under the work scaffold from the top surface thereof to the discharge port in the closed state of the bottom portion of the hollow staicture, adding a next rack rail to the lower end of the rack rail under the work scaffold by the worker connected to the work scaffold with the safety belt in a state where the passage is blocked with the poke and broken granular powder, opening the discharge port of the bottom portion of the hollow structure to discharge the granular powder stored in the passage, and then towering the lifting body to the added rack rail to lower the work scaffold.

In the method for discharging a granular powder brought into a fixed state inside a hollow structure according to the present invention, the passage formed in the granular powder in the fixed state from the top surface thereof to the discharge port in the closed state of the silo bottom portion is a rat hole formed in the vertical direction in the granular powder stored in the hollow structure from the top surface thereof to the discharge port of the bottom portion of the hollow structure by the fixation and lamination of the granular powder in the hollow structure on the inner surface of the hollow structure and may be formed from the beginning.

In the method for discharging a granular powder brought into a fixed state inside a hollow structure according to the present invention, the passage formed in the granular powder in the fixed state from the top surface thereof to the discharge port in the closed state of the silo bottom portion is an artificial hole formed by boring in the vertical direction in the granular powder brought into the fixed state in the hollow structure and may be formed before the process of poking and breaking down the granular powder in the fixed state under the work scaffold by the worker connected to the work scaffold with the safety belt.

In the method for discharging a granular powder brought into a fixed state inside a hollow structure according to the present invention, the process of suspending the rack rail of a predetermined length into the upper space in the hollow structure from the opening formed in the ceiling portion of the hollow structure may include repeat processes of temporarily placing the lifting body in the opening, inserting the rack rail into the lifting body from above, driving a pinion provided inside the lifting body to send out the inserted rack rail below the lifting body, stopping the sending-out once in a state where the upper end of the rack rail while being sent out projects from an upper portion of the lifting body, adding a next rack rail to the upper end of the rack rail projecting from the upper portion of the lifting body, and then sending out the added rack rail below the lifting body.

In the method for discharging a granular powder brought into a fixed state inside a hollow structure according to the present invention, the process of lowering the lifting body moving along the rack rail from the opening to the upper space in the hollow structure along the rack rail may include supporting the upper end of the rack rail projecting upward from the lifting body temporarily placed in the opening on a mount provided on the ceiling portion of the hollow structure, releasing the temporal placement to the opening of the lifting body, and then driving the pinion provided inside the lifting body in a direction opposite to the direction when sending out the rack rail downward to thereby lower the lifting body from the opening along the rack rail.

Advantage of the Invention

According to the method for discharging a granular powder brought into a fixed state in the silo of the present invention, the passage (rat hole, artificial hole) formed in the vertical direction in the granular powder in the fixed state in the silo is utilized not only as a discharge path for the poked and broken down granular powder but as a temporary placing space where the poked and broken down granular powder is temporarily stored. More specifically, the poked and broken down granular powder is dropped to the passage to be temporarily stored in the state where the discharge port of the silo bottom portion is closed and the rack rail is added in the state where the passage is blocked with the granular powder, and therefore the safety can be improved as much as possible.

MODE FOR CARRYING OUT THE INVENTION

Figure 1:
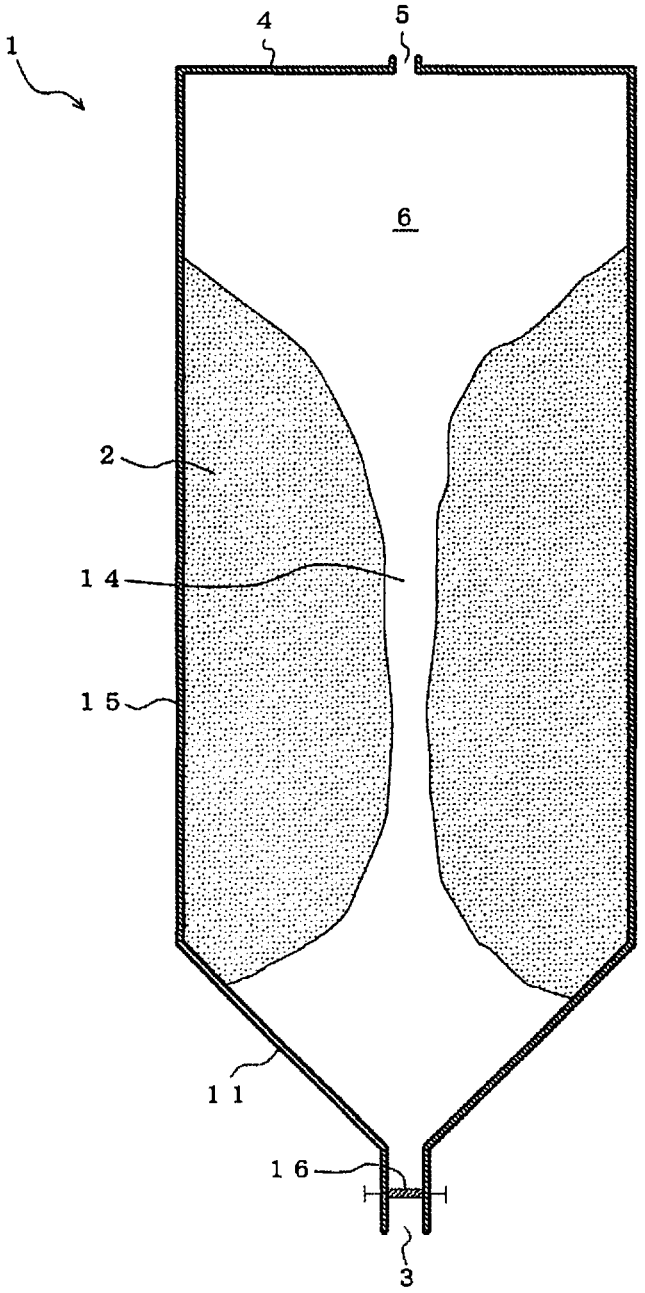
FIG. 1 is a side cross-sectional view of a silo in which a rat hole is formed to which a "Method for discharging a granular powder brought into a fixed state inside a hollow structure" which is one embodiment of the present invention is applied.

Hereinafter, preferable embodiments of the present invention are described in detail with reference to the accompanying drawings. The dimensions, the materials, the other specific numerical values, and the like described in the embodiments are merely examples for facilitating the understanding of the invention and do not limit the present invention unless otherwise particularly specified. In this specification and the drawings, elements having the substantially same functions and configurations are designated by the same reference numerals, and thus duplicated descriptions are omitted and the elements not directly related to the present invention are not shown.

(Outline of a Method for Discharging Granular Powder 2 Brought into Fixed State Inside the Hollow Structure (silo 1))

The outline of processes of a method for discharging a granular powder 2 brought into a fixed state in a silo 1 according to one embodiment of the present invention is described based on the accompanying drawings. This method is a method including, when the granular powder 2 stored in the silo 1 is brought into a fixed state and cannot be discharged from a discharge port 3 of a silo bottom portion 11 as shown in FIG. 1, breaking down the granular powder 2 in the fixed state, and then discharging the same from the discharge port 3. Hereinafter, the silo 1 is described but the same applies to hollow structures, such as a tank, a bottle, and a country elevator. The outline of this method is as follows.

Figure 6:
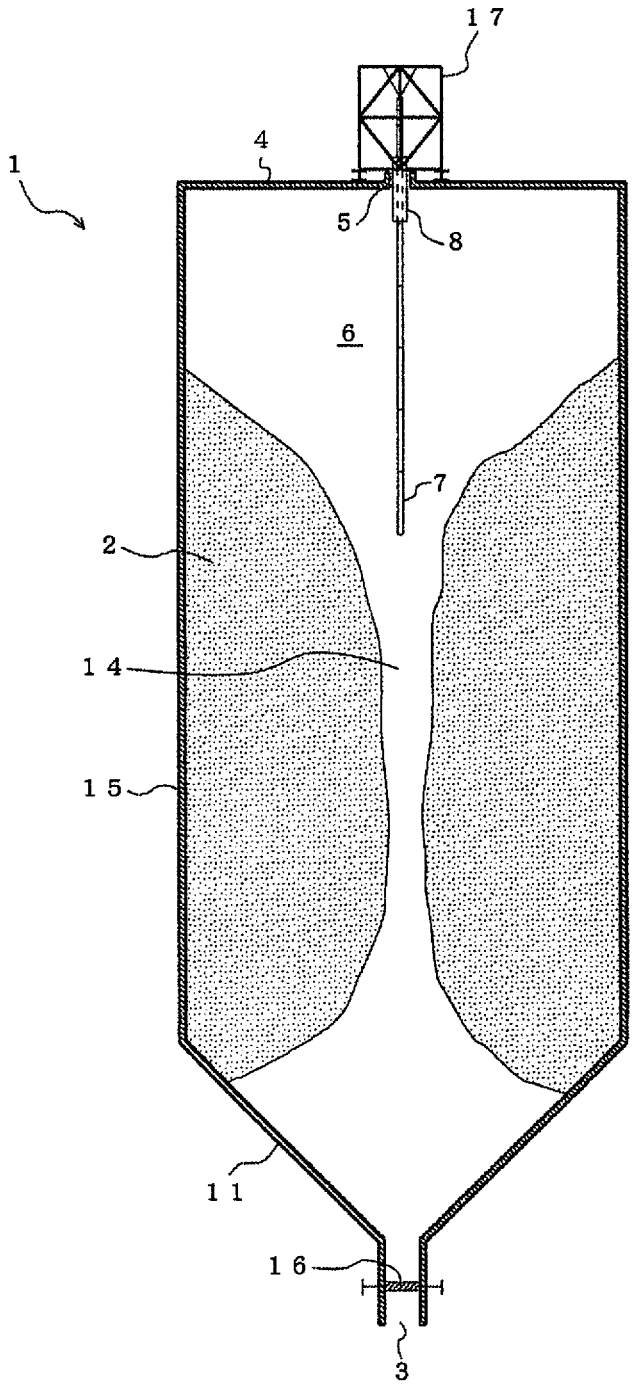
FIG. 6 is a side cross-sectional view of the silo showing the following process.
Figure 7:
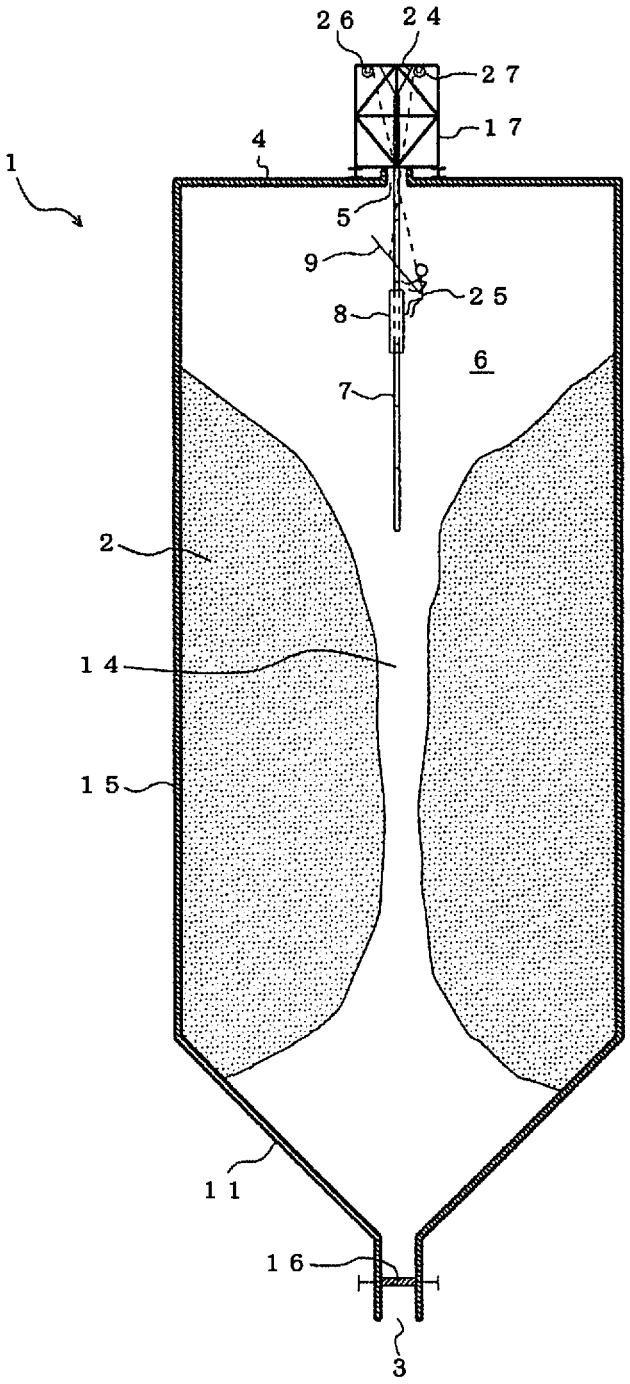
FIG. 7 is a side cross-sectional view of the silo showing the following process.
Figure 8:
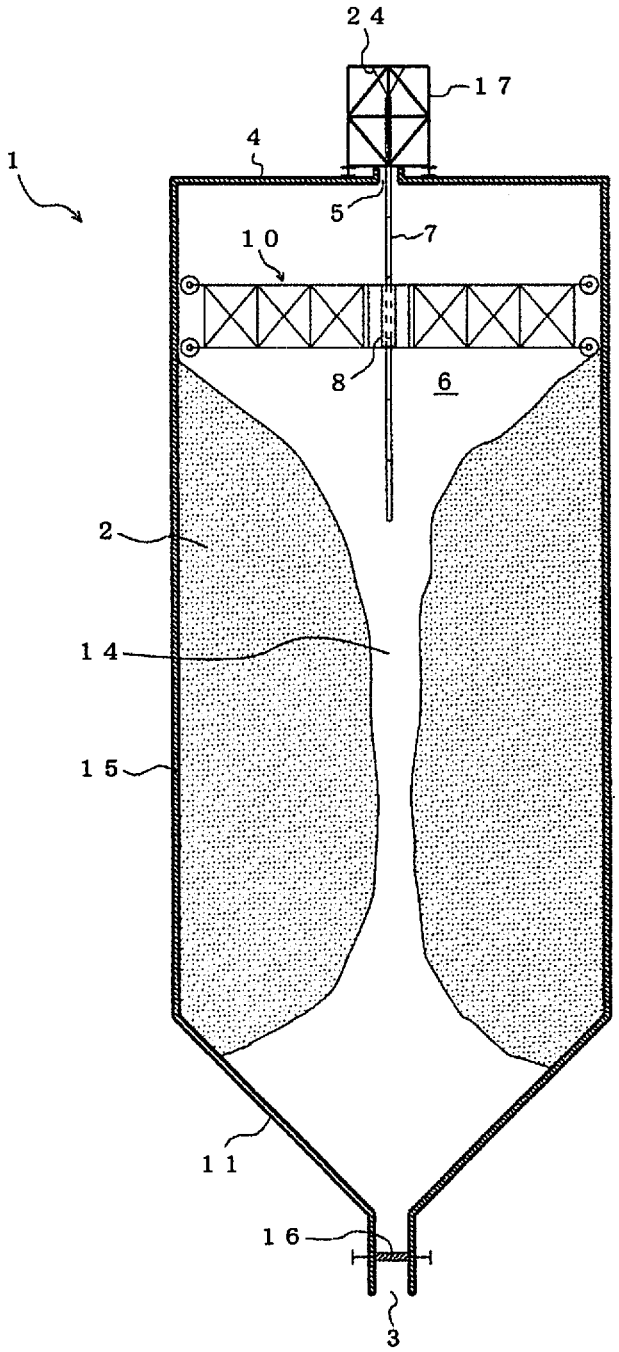
FIG. 8 is a side cross-sectional view of the silo showing the following process.

As shown in FIG. 6, a rack rail 7 of a predetermined length is suspended into an upper space 6 in the silo 1 from an opening 5 formed in a ceiling portion 4 of the silo 1. As shown in FIG. 7, a lifting body 8 moving along the rack rail 7 is lowered from the opening 5 to the upper space 6 in the silo 1 along the rack rail 7, and then a work scaffold 10 (see FIG. 9A and FIG. 9B) is built on the lifting body 8 so as to project in the horizontal direction in the upper space 6 in the silo 1 as shown in FIG. 8 using a part 9 carried into the silo 1 from the opening 5.

Figure 10:
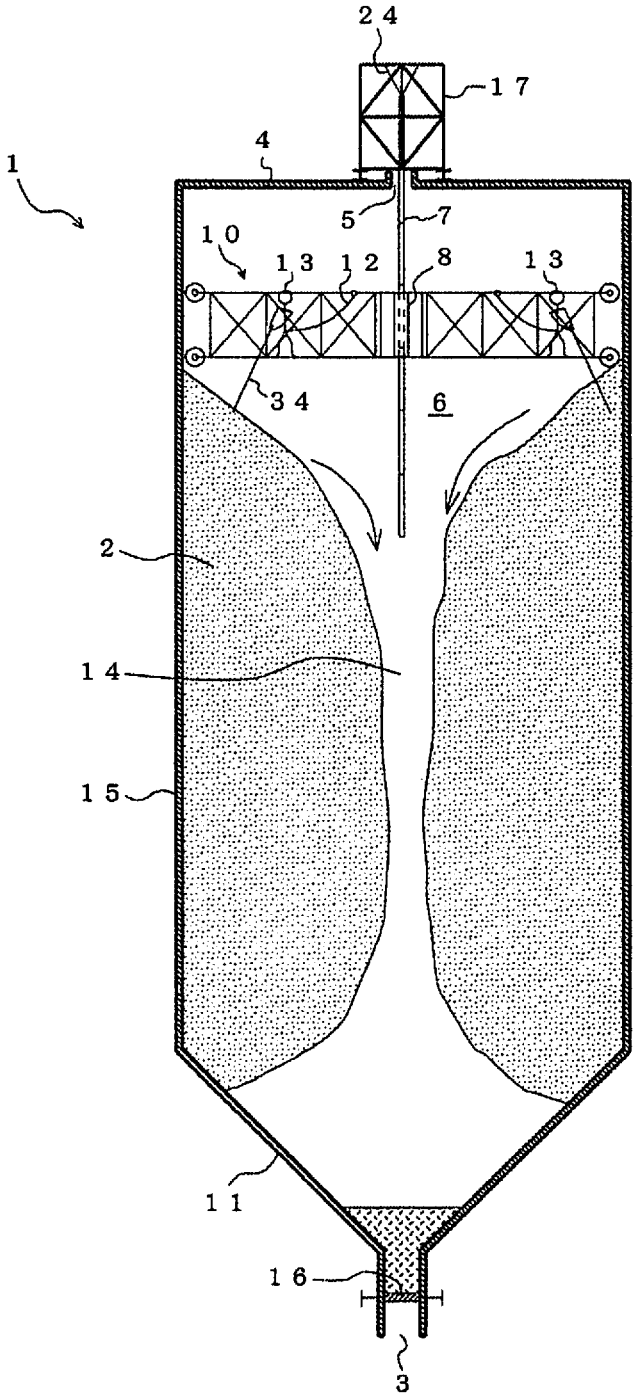
FIG. 10 is a side cross-sectional view of the silo showing a process subsequent to that of FIG. 8.
Figure 11:
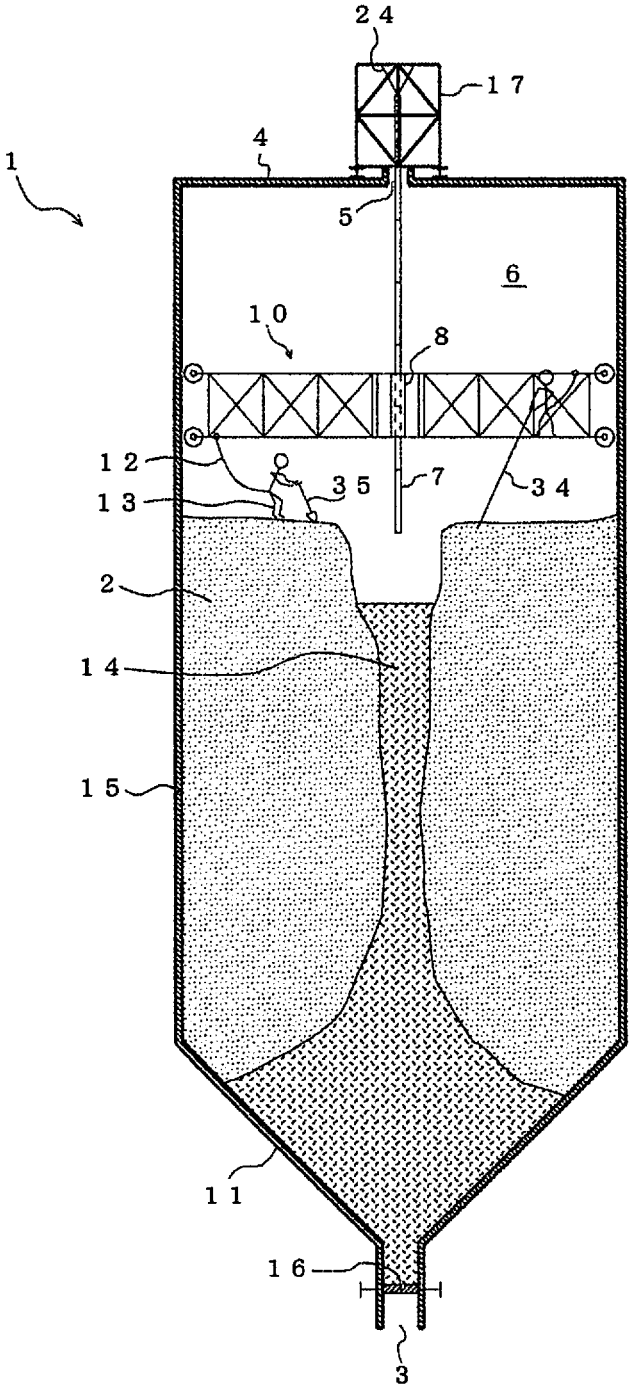
FIG. 11 is a side cross-sectional view of the silo showing the following process.

As shown in FIG. 10, workers 13 connected to the work scaffold 10 with safety belts 12 poke and break down the granular powders 2 in the fixed state under the work scaffold 10 in a state where the discharge port 3 of the silo bottom portion 11 is closed, and then drop the poked and broken down granular powders 2 to a passage 14 (rat hole, artificial hole) formed in the granular powder 2 in the fixed state under the work scaffold 10 from the top surface thereof to the discharge port 3 in the closed state of the silo bottom portion 11 as shown in FIG. 11.

Figure 12:
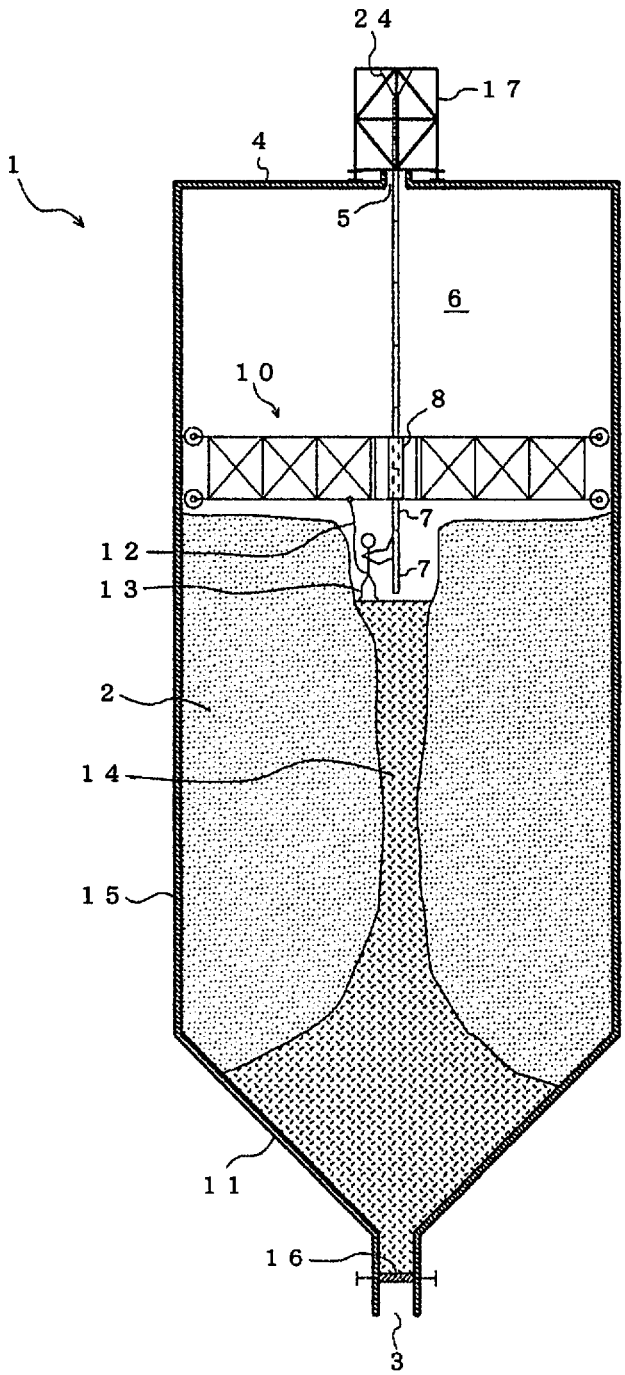
FIG. 12 is a side cross-sectional view of the silo showing the following process.
Figure 13:
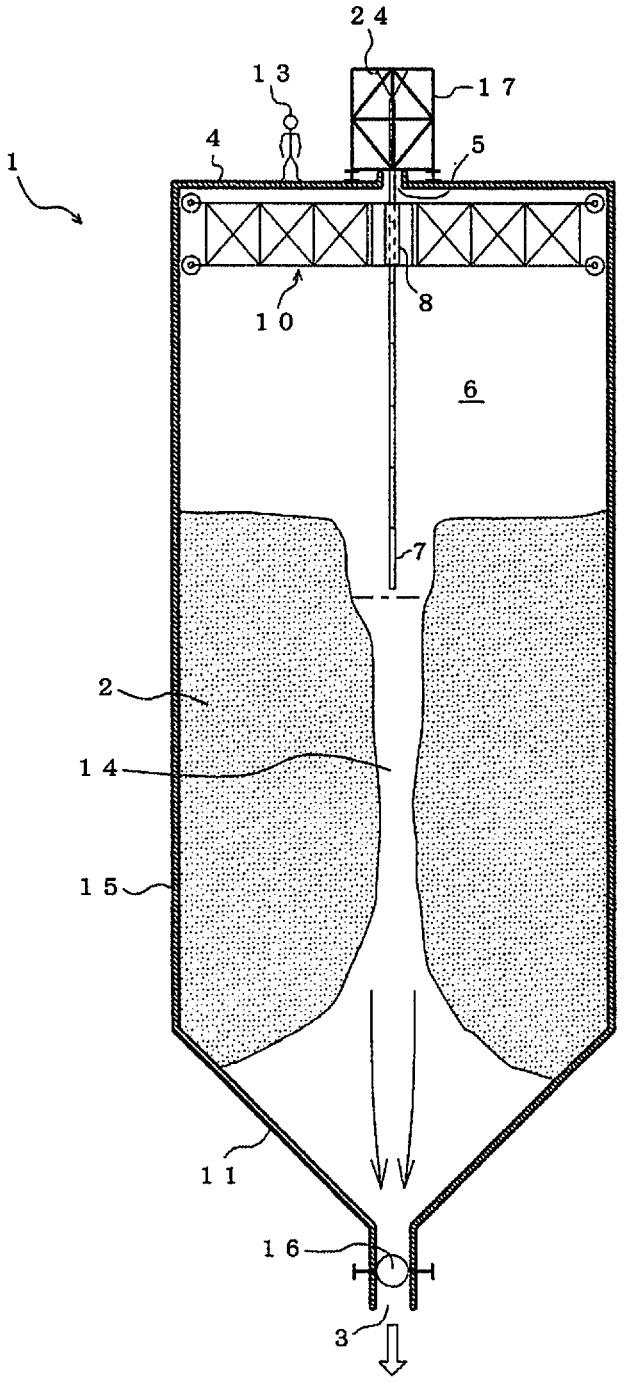
FIG. 13 is a side cross-sectional view of the silo showing the following process.
Figure 16:
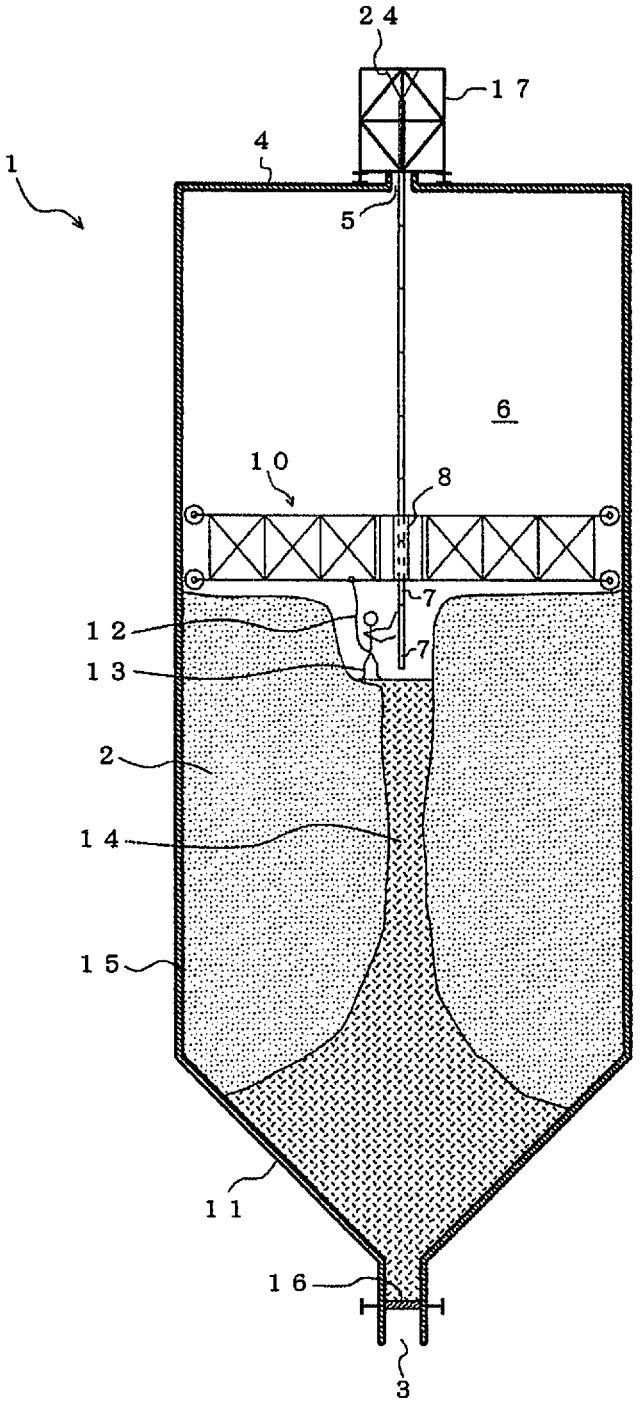
FIG. 16 is a side cross-sectional view of the silo showing the following process.
Figure 19:
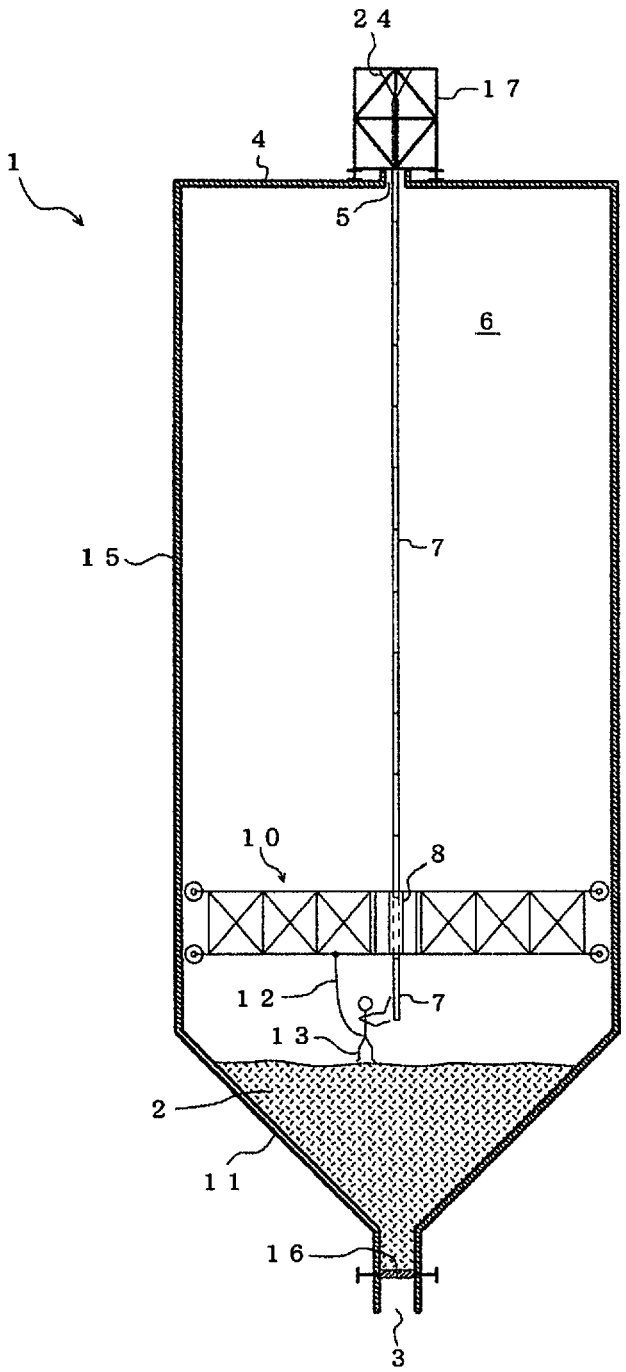
FIG. 19 is a side cross-sectional view of the silo showing the following process.

As shown in FIG. 12, the worker 13 connected to the work scaffold 10 with the safety belt 12 adds a next rack rail 7 to the lower end of the rack rail 7 under the work scaffold 10 in a state where the passage 14 (rat hole, artificial hole) is blocked with the poked and broken down granular powder 2. As shown in FIG. 13, the discharge port 3 of the silo bottom portion 11 is opened, and then the granular powder 2 stored in the passage 14 (rat hole, artificial hole) is discharged. Thereafter, the lifting body 8 is lowered to the added rack rail 7 to lower the working scaffold 10 as shown in FIG. 19 to FIG. 16.

By repeating the processes of adding the next rack rail 7 to the lower end of the rack rail 7 under the work scaffold 10 in the state where the passage 14 (rat hole, artificial hole) is blocked with the poked and broken down granular powder 2, and then lowering the lifting body 8 to the added rack rail 7 to lower the work scaffold 10 as described above (FIG. 17 to FIG. 21), the rack rail 7 is gradually extended downward to gradually lower the work scaffold 10, and then the fixed granular powder 2 in the silo 1 is gradually poked and broken down from above. Hereinafter, the detail description is given.

(Silo 1)

As shown in FIG. 1, the silo 1 storing the granular powders (grains, feeds, and the like) 2 contains a cylindrical barrel portion 15, a mortar-shaped (funnel-shaped) bottom portion 11, and a plate-like ceiling portion 4. In the ceiling portion 4, the opening 5 (inlet port) for charging the granular powder 2 into the silo 1 is formed. In the bottom portion 11, a discharge port 3 (outlet port) for discharging the stored granular powder 2 in the silo 1 is formed. The outlet port 3 is provided with an opening and closing valve 16. The inlet port 5 and the outlet port 3 are disposed at the center of the silo 1 in this embodiment but may shift from the center. The opening 5 is not limited to the inlet port and may be a manhole for inspection provided in the center of the ceiling portion 4.

In the silo 1 in this embodiment, the full length (height) of the silo 1 is about 20 to 30 m, the diameter of the silo 1 is about 5 to 7 m, the opening diameter of the inlet port 5 is about 60 cm, the opening diameter of the outlet port 3 is about 60 cm. and the storage amount of the silo 1 is about 200 to 10001. The silo 1 is not limited to the sizes.

(Rat Hole 14)

The granular powder (grains, feeds, and the like) 2 stored in the silo 1 is pressed against the inner surface of the silo 1 due to the total weight of the granular powder 2 itself to be brought into a consolidated state and fixed depending on the moisture content of the granular powder 2, the environmental factors, such as weather (humidities and temperatures), when the granular powder is taken into/out of the silo 1, and the like, and then the granular powder 2 is further pressed thereagainst to be laminated thereon.

Such lamination is repeated so that the rat hole 14 is formed in some cases.

In this embodiment, the passage 14 formed in the granular powder 2 in the fixed state from the top surface thereof to the discharge port 3 of the silo bottom portion 11 in the silo 1 as shown in FIG. 1 is the rat hole 14. The rat hole 19 is formed before (from the beginning) the method for discharging the granular powder 2 according to this embodiment is carried out.

(Artificial Hole 14: Boring Hole)

The granular powder 2 stored in the silo 1 is brought into a consolidated state in an upper portion of the discharge port 3 of the silo bottom portion 11 formed in the funnel shape due to the total weight of the granular powder itself to be fixed in an arch shape (bridge) in some cases.

When the bridge is formed, the granular powder 2 stored in the silo 1 may be entirely brought into a fixed state. In this case, an artificial hole (boring hole) is formed by boring in the vertical direction in the granular powder 2 brought into the fixed state.

More specifically, the passage 19 may be an artificial hole formed by boring in the granular powder brought into the fixed state in the silo 1. Such an artificial hole (boring hole) 14 is formed in the granular powder 2 in the fixed state from the top surface thereof to the discharge port of the silo bottom portion 1 by a boring machine inserted into the silo 1 from the inlet port 5 shown in FIG. 1 or by a boring machine supported by the work scaffold 10 shown in FIG.

8. The artificial hole 14 is formed before the process of poking and breaking down the granular powder 2 in the fixed state by the workers 13 as shown in FIG. 10.

(Preparation for Suspending Rack Rail 7)

Figure 2:
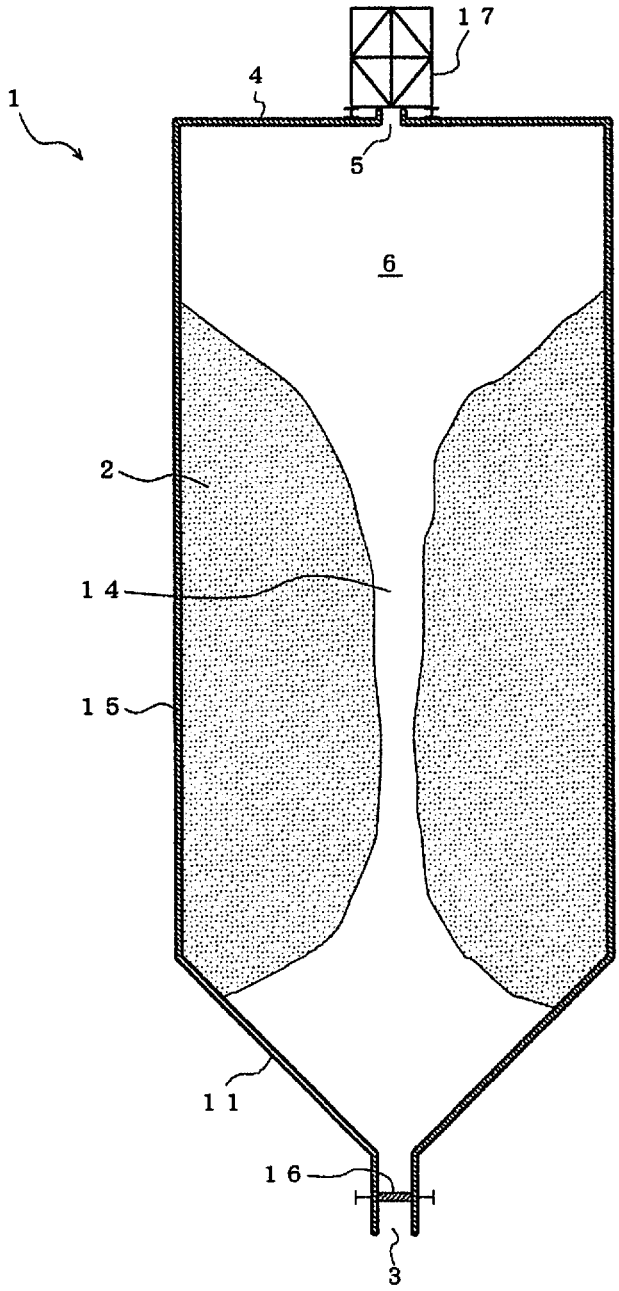
FIG. 2 is a side cross-sectional view of a silo showing a first process of the "Method for discharging a granular powder brought into a fixed state inside a hollow structure" according to one embodiment of the present invention.

A mount (tower) 17 for suspending the rack rail 7 is installed on the upper surface of the ceiling portion 4 of the silo 1 to be matched with the position of the inlet port 5 as shown in FIG. 2. Since the lifting body 8 is mounted on the rack rail 7 and the work scaffold 10 is attached to the lifting body 8 as described later, the tower 17 is required to have strength allowing the tower 17 to suspend the weights of the lifting body 8 and the work scaffold 10 in addition to the weight of the rack rail 7. Moreover, since the tower 17 is mounted on the ceiling portion 4 of the silo 1, the weight needs to be reduced as much as possible in order to reduce the load to the silo 1, and thus the tower 17 is configured in a cage shape (truss shape) from a plurality of rod materials (member).

Figure 3:
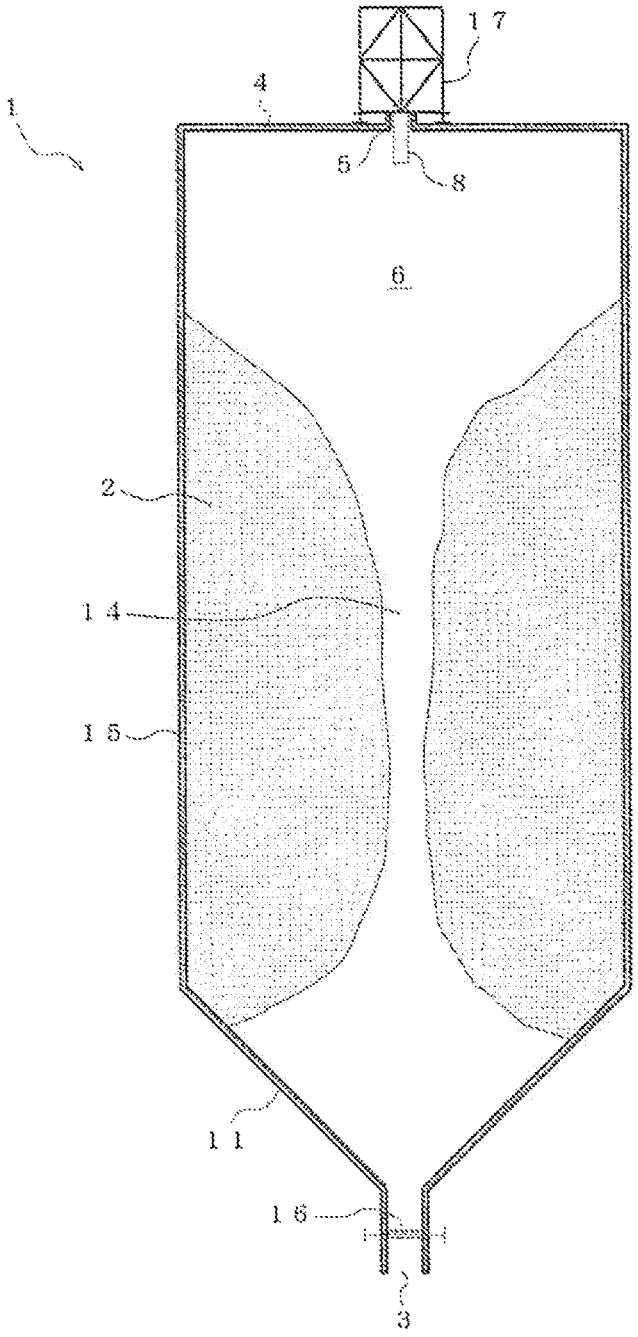
FIG. 3 is a side cross-sectional view of the silo showing the following process.
Figure 4:
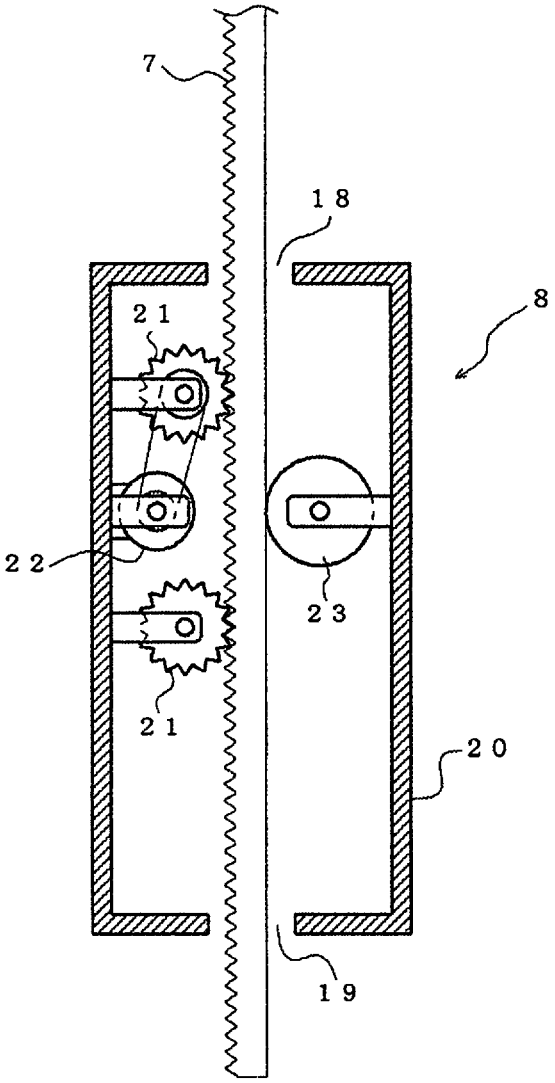
FIG. 4 is a side cross-sectional view of a lifting body to be used for the "Method for discharging a granular powder brought into a fixed state inside a hollow structure" according to this embodiment.

As shown in FIG. 3 the lifting body (actuator) 8 is temporarily installed in the inlet port 5 for the time being. As shown in FIG. 4, the lifting body 8 is provided with a casing 20 having openings 18 and 19 in the upper and lower sides, pinions 21 provided there inside. a motor 22 driving the pinions 21, and a press roller 23 provided inside the casing 20 and is configured so that the rack rail 7 is held between the pinions 21 and the press roller 23.

The lifting body 8 is not limited to the above-described configuration insofar as it is a structure capable of going up and down along the rack rail 7. For example, the lifting body 8 according to this embodiment has the configuration in which one press roller 23 is disposed between the two pinions 21 as shown in FIG. 4 but may have a configuration in which one pinion 21 is disposed between two press rollers 23.

(Suspension of Rack Rail 7)

Figure 5:
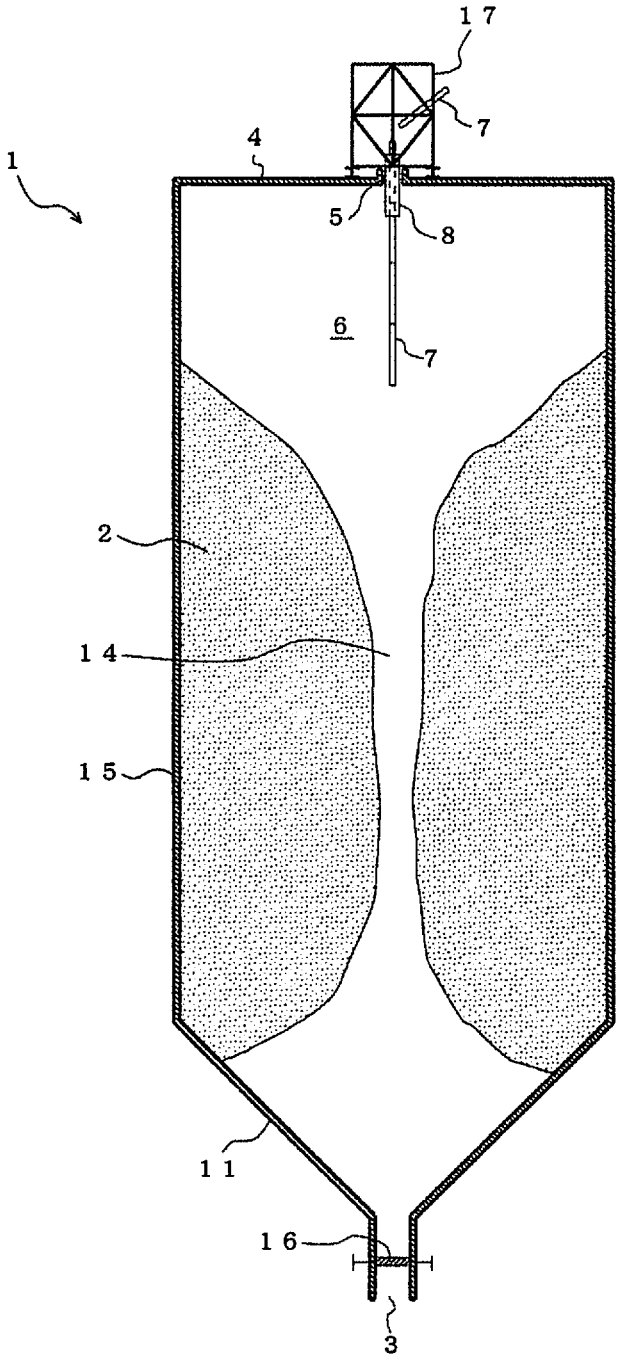
FIG. 5 is a side cross-sectional view of the silo showing a process subsequent to that of FIG. 3.

As shown in FIG. 5, the rack rail 7 of a predetermined length is inserted from the upper opening 18 of the casing 20 of the lifting body 8, and then the pinions 21 shown in FIG. 4 are rotated with the motor 22 to send out the rack rail 7 downward to project the same downward from the lower opening 19 of the casing 20. Then, in the state where the upper end of the rack rail 7 projects upward from the upper opening 18 of the casing 20 of the lifting body, the next rack rail 7 is added to the upper end of the rack rail 7, and then the added rack rail 7 is similarly sent out downward by the pinions 21. By repeating this work, the rack rail 7 is suspended into the upper space 6 in the silo 1 from the inlet port 5 formed in the ceiling portion 4 of the silo 1 as shown in FIG. 6. According to this work, the rack rail 7 can be added outside the silo 1, and then suspended into the silo 1 from the inlet port 5. Therefore, the safety is higher than that in a case of performing the work of adding the rack rail 7 inside the silo 1.

As shown in FIG. 6, the length (total length of the added rack rail 7) of the rack rail 7 suspended from the inlet port 5 is set to a length in which the lower end of the rack rail 7 is not inserted into the rat hole (passage)14. This is because, when dropping the poked and broken down granular powder 2 to the rat hole 14, the rack rail 7 does not block the granular powder 2 dropping through the inside of the rat hole 14. When the passage 14 is the artificial hole formed by boring, the rat hole 14 described above is read as the artificial hole 14. As the length of the rack rail 7 alone, one having a length of about 1.5 to 2 m is used, for example.

(Lowering of Lifting Body 8)

As shown in FIG. 6, after adding the rack rail 7 to extend the same from the inlet port 5 to the entrance of the rat hole 14, the upper end of the rack rail 7 projecting upward from the upper opening 18 of the casing 20 of the lifting body 8 and a top portion of the tower 17 are connected by a connection member, such as a wire 24. Then, a temporary installation mechanism (not shown) of temporarily installing the lifting body 8 in the inlet port 5 is removed. Thus, the weights of the rack rail 7 and the lifting body 8 are suspended by the tower 17 through the wire 24. Thereafter, the pinions 21 inside the lifting body 8 shown in FIG. 4 are rotated in a direction opposite to the direction when sending out the rack rail 7 downward, whereby the lifting body 8 is lowered from the inlet port 5 to the upper space 6 in the silo 1 along the rack rail 7 as shown in FIG. 7. The drive (normal rotation, reverse rotation) of the motor 22 (see FIG. 4) driving the pinions 21 of the lifting body 8 is remote-controlled (wired or wireless) by operating an operation board provided near the tower 17. Since such work is work outside the silo 1 and is not work inside the silo 1, the safety is high.

(Building of Work Scaffold 10)

After lowering the lifting body 8 to the upper space 6 in the silo 1, the work scaffold 10 is built so as to project in the horizontal direction on the lifting body 8 in the upper space 6 in the silo 1 using the part 9 carried into the silo 1 from the inlet port 5 as shown in FIG. 7 (see FIG. 8).

As shown in FIG. 7, a worker 25 performing the building work is connected to a wire delivered from a winch 26 attached to the tower 17 through a safety belt, and enters the silo 1 from the inlet port 5. The part 9 of the work scaffold 10 is connected to a wire delivered from another winch 27 attached to the tower 17 and carried into the silo 1 from the inlet port 5. The worker 25 attaches the part 9 suspended from the wire of the other winch 27 to the lifting body 8 in the state of being suspended from the wire of the winch 26 in the upper space 6 in the silo 1. Thus, the work scaffold 10 is built so as to project in the horizontal direction on the lifting body 8 as shown in FIG. 8.

Figure 9A:
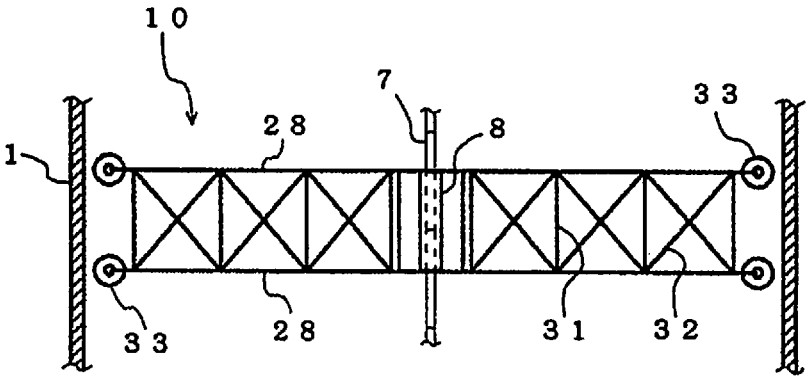
FIG. 9A is a side cross-sectional view as an explanatory view of a work scaffold to be used for the "Method for discharging a granular powder brought into a fixed state inside a hollow structure" according to this embodiment.
Figure 9B:
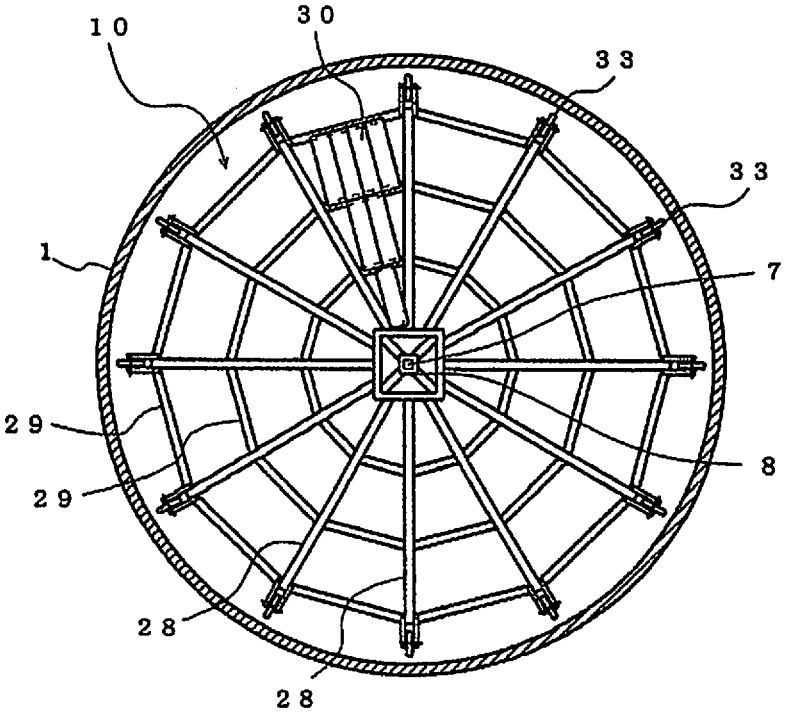
FIG. 9B is a plan view as an explanatory view of a work scaffold to be used for the "Method for discharging a granular powder brought into a fixed state inside a hollow structure" according to this embodiment.

The work scaffold 10 has radial direction members 28 radially disposed in the radial direction of the silo 1 with the lifting body 8 as the center and circumferential direction members 29 connecting the radial direction members 28 as shown in FIG. 9B. Two or more (for example, 12) of the radial direction members 28 are disposed at equal angles (for example, 30°) in the circumferential direction of the silo 1 and the circumferential direction members 29 are disposed in a plurality of rows (for example, three rows) at intervals in the radial direction of the silo 1. Between the radial direction members 28 and the circumferential direction members 29, floor boards 30 are laid. In FIG. 9B, only some of the floor boards 30 are shown for convenience of the drawing of the figure.

The work scaffold 10 has reinforcing members 31 and diagonal members 32 and is configured in a cage shape as a whole as shown in FIG. 9A. Guide rollers 33 are provided on the tips of the radial direction members 28. When the work scaffold 10 goes up and down along the rack rail 7, the guide rollers 33 contacts the inner surface of the silo 1 to guide the going up and down.

The weight of the work scaffold 10 is supported by the ceiling portion 4 of the silo 1 through the rack rail 7, the wire 24, and the tower 17 as shown in FIG. 8. Therefore, it is preferable to reduce the weight of the work scaffold 10 as much as possible in consideration of a burden on the strength of the silo 1. Since the work scaffold 10 has a space frame structure configured in the cage shape from the radial direction members 28, the circumferential direction members 29, the floor boards 30, the reinforcing members 31, the diagonal members 32, and the like in this embodiment, the weight reduction as much as possible is achieved while securing the strength required when the workers 13 perform work while riding thereon as shown In FIG. 1D. The work scaffold 10 may be provided with an operation board for controlling the drive motor 22 (see FIG. 4) of the lifting body 8.

(Poking and Breaking Down of Granular Powder 2)

After the work scaffold 10 is completed, the workers 13 connected to the work scaffold 10 with the safety belts 12 poke and break down the granular powders 2 in the fixed state under the work scaffold 10 in a state where the opening and closing valve 16 of the outlet port 3 of the silo bottom portion 11 is closed as shown in FIG. 10. Then, the poked and broken down granular powder 2 is dropped to the rat hole 14 (or artificial hole formed by boring) as shown in FIG. 11.

The workers 13 may poke and break down the granular powders with a rod or rake 34, for example, from gaps between the floor boards 30 in a state of riding on the work scaffold 10 as shown in FIG. 10 or the worker 13 may poke and break down the granular powder 2 with a pick or shovel 35, a power tool (breaker, chipper), or the like in a state of riding on the granular powder 2 under the work scaffold 10 as shown in FIG. 11. The workers 13 are connected to the work scaffold 10 with the safety belts 12 in any case.

A space is formed under the work scaffold 10 by poking and breaking down the granular powders 2 as shown in FIG. 10, and therefore the work scaffold 10 is lowered to the space along the rack rail 7 as shown in FIG. 11.

Thus, the distance (height difference) between the worker 13 riding on the granular powder 2 and the work scaffold 10 is reduced, and therefore the worker 13 performing the poking and breaking down work in the state of riding on the granular powder 2 can perform the work using the safety belt 12 of a short length, and thus the safety increases.

(Addition of Rack Rail 7)

As shown in FIG. 11, after the rat hole (or artificial hole) 14 is blocked with the poked and broken down granular powder 2, the worker 13 connected to the work scaffold 10 with the safety belt 12 adds the next rack rail 7 to the lower end of the rack rail 7 projecting downward from the work scaffold 10 as shown in FIG. 12.

When the worker 13 performs the work of adding the rack rail 7, the inside of the rat hole (or artificial hole) 14 is blocked with the poked and broken down granular powder 2 in FIG. 12. Therefore, even when the safety belt 12 is temporarily (at the worst) removed, an accident that the worker 13 falls through the inside of the rat hole (or artificial hole) 14 to the silo bottom portion 11 can be prevented, and the addition work of the rack rail 7 can be performed with high safety. Moreover, since the worker 13 can perform the work in the state of riding on the upper suffice of the granular powder 2 stored in the rat hole (or artificial hole)14, the workability improves.

Herein, it is preferable to continue the poking and breaking down work of the granular powders 2 shown in FIG. 10 until the rat hole (or artificial hole) 14 is blocked with the granular powder 2 to the vicinity of the entrance as shown in FIG. 11. This is because the worker 13 riding on the upper surface of the granular powder 2 stored in the rat hole (or artificial hole) 14 performs the addition work of connecting the upper end of the new rack rail 7 to the lower end of the rack rail 7 projecting from below the work scaffold 10 in the additional work of the rack rail 7 shown in FIG. 12, the hands easily reach a connection portion between the rails, so that the workability can be improved. Moreover, this is because a situation where the length of the safety belt 12 connecting the worker 13 to the work scaffold 10 unnecessarily becomes long can be avoided, so that the safety can be improved. The length of the safety belt 12 used by the worker 13 is shortened as much as possible by lowering the work scaffold 10 of FIG. 11 to the position of FIG. 12.

(Discharge of Granular Powder 2)

After adding the rack rail 7, the work scaffold 10 is raised along the rack rail 7 in the state where the worker 13 rides thereon as shown in FIG. 13.

Then, after the worker 13 comes out of the inlet port 5 to the outside of the silo 1, the opening and closing valve 16 of the outlet port 3 of the silo bottom portion 11 is opened. Thus, the granular powder 2 temporarily stored in the rat hole (or artificial hole) 14 is discharged from the outlet port 3. At this time, the worker 13 comes out to the outside of the silo 1, and therefore the worker 13 is not involved in the granular powder 2 to be discharged and thus is safe.

(Lowering of Work Scaffold 10)

Figure 14:
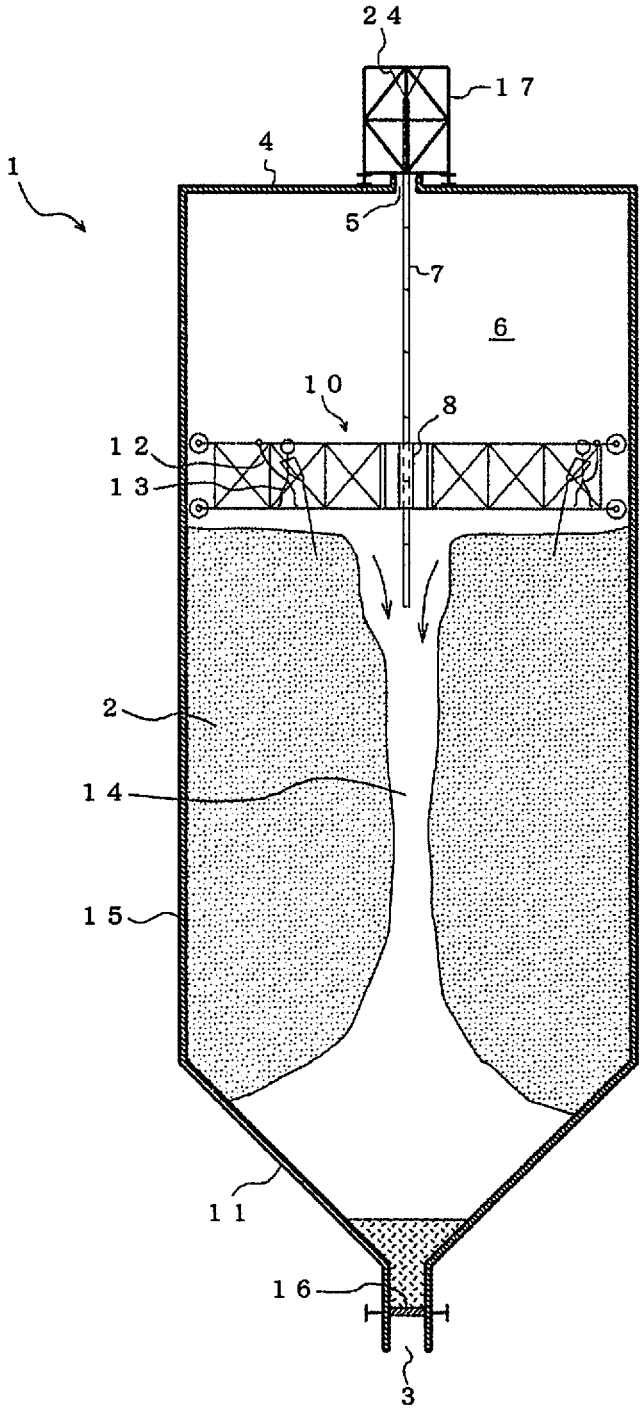
FIG. 14 is a side cross-sectional view of the silo showing the following process.
Figure 15:
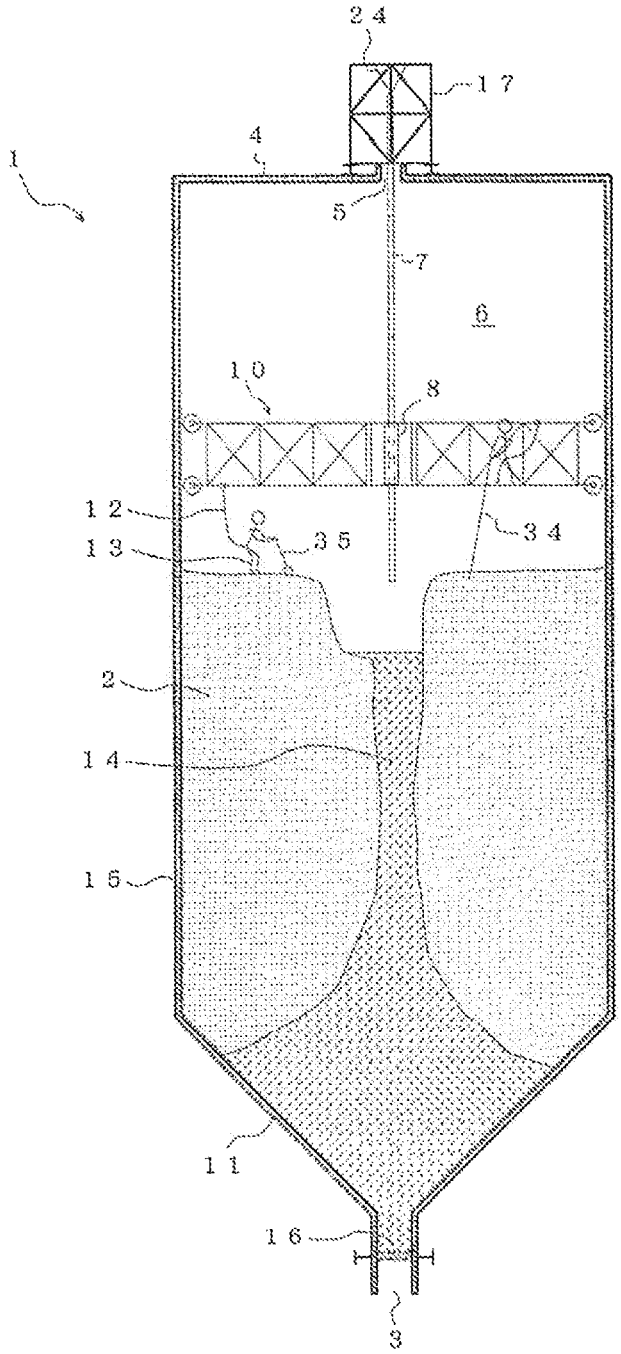
FIG. 15 is a side cross-sectional view of the silo showing the following process.

After discharging the granular powder 2, the workers 13 enter the silo 1 from the inlet port 5. ride on the work scaffold 10, and then lower the work scaffold 10 as shown in FIG. 14. Then, the workers 13 connected to the work scaffold 10 with the safety belts 12 perform the poking and breaking down work of the fixed granular powder 2 in the state where the opening and closing valve 16 of the outlet port 3 is closed, and then drop the poked and broken down granular powder 2 to the rat hole (or artificial hole formed by boring) 14 as shown in FIG. 15. FIG. 14 shows the same work as that of FIG. 10. FIG. 15 shows the same work as that of FIG. 11.

Figure 17:
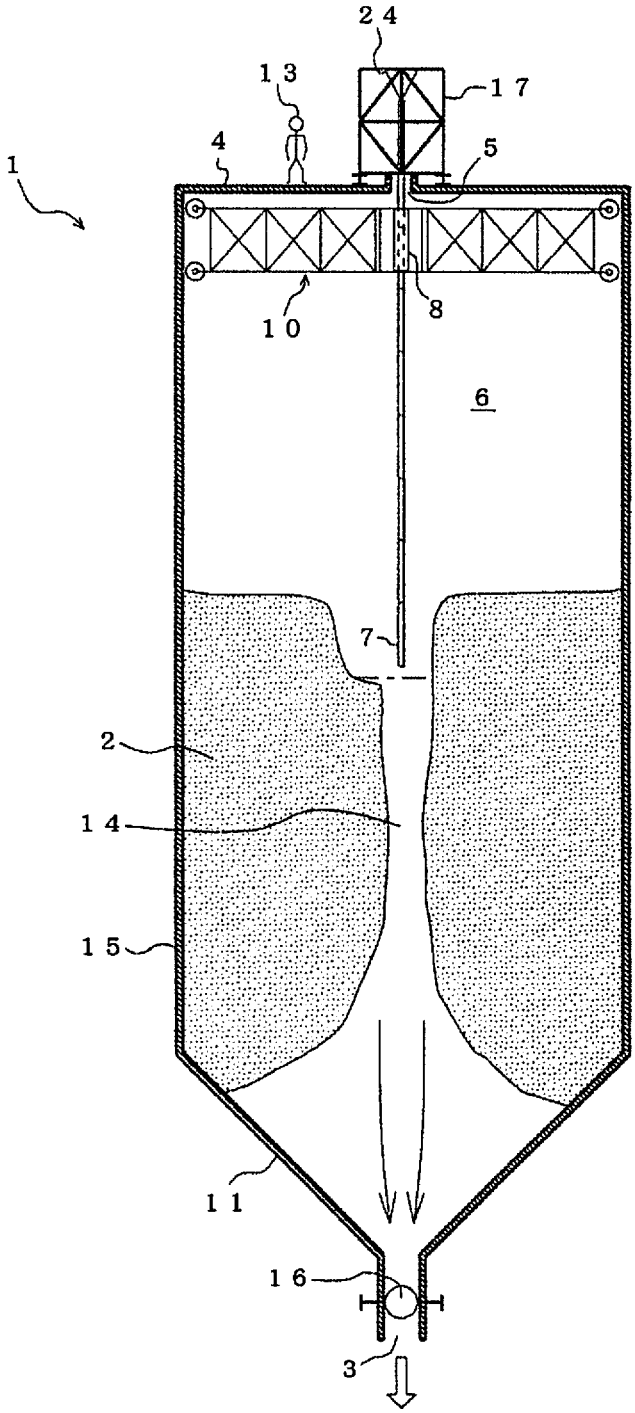
FIG. 17 is a side cross-sectional view of the silo showing the following process.

Thereafter, the work scaffold 10 is previously lowered to the position of the rack rail 7 added in FIG. 12 as shown in FIG. 16. Then, the worker 13 connected to the work scaffold 10 with the safety belt 12 adds the next rack rail 7 to the rack rail 7 projecting from below the work scaffold 10. FIG. 16 shows the same work as that of FIG. 12. Then, after the work scaffold 10 is raised, and then the worker 13 comes out of the inlet port 5 to the outside of the silo 1, the opening and closing valve 16 of the outlet port 3 is opened, and then the granular powder 2 stored in the rat hole 14 is discharged as shown in FIG. 17. FIG. 17 shows the same work as that of FIG. 13.

(Repetition of Work)

The above-described work is repeated. More specifically, by repeating the work of adding the next rack rail 7 to the rack rail 7 projecting from below the work scaffold 10, and then lowering the work scaffold to the added rack rail 7 in the state where the rat hole 14 is blocked with the poked and broken down granular powder 2, the granular powder 2 brought into the fixed state in the silo 1 is gradually poked and broken down from above, and then discharged from the outlet port 3 of the silo bottom portion 11.

Figure 18:
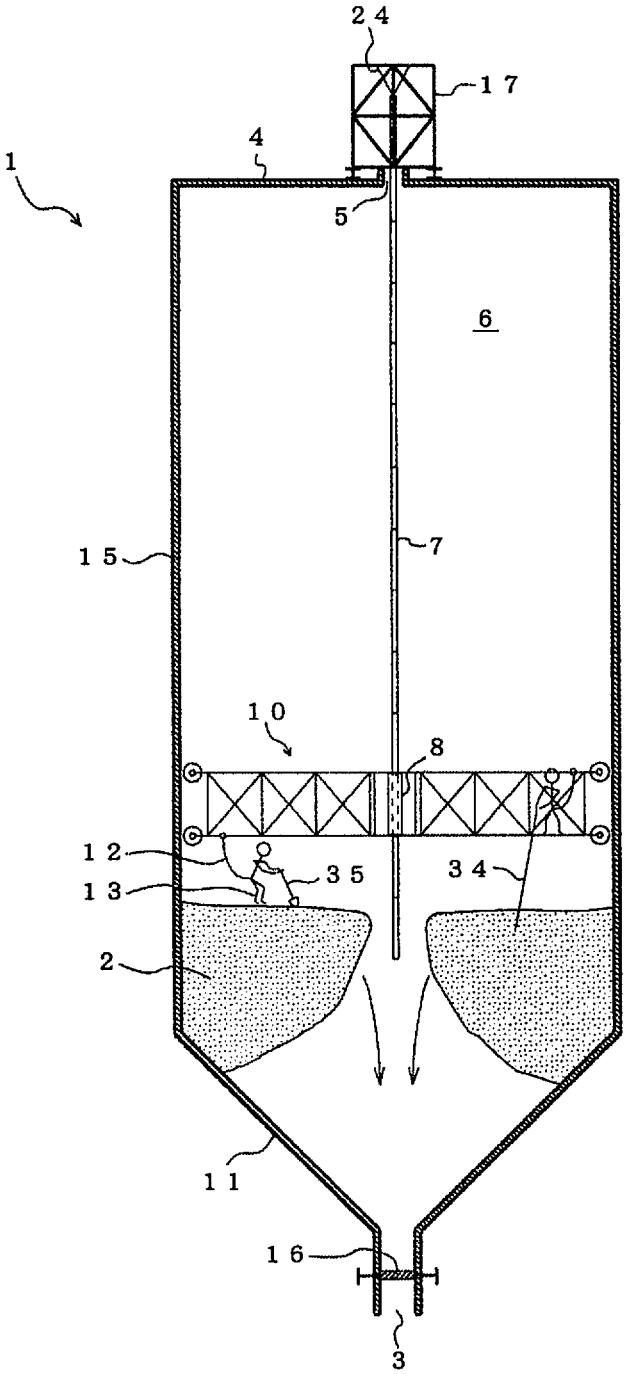
FIG. 18 is a side cross-sectional view of the silo showing the following process.

Then, when the work scaffold 10 is lowered to a lower portion of the silo 1 as shown in FIG. 18. the worker 13 connected to the work scaffold 10 with the safety belt 12 pokes and breaks down all the granular powders 2 in the fixed state in the silo 1, and then stores the same in the silo bottom portion 11 as shown in FIG. 19. Thereafter, the worker 13 connected to the work scaffold 10 with the safety belt 12 adds the rack rail 7 in a state of riding on the granular powder 2 stored in the silo bottom portion 1.

Figure 20:
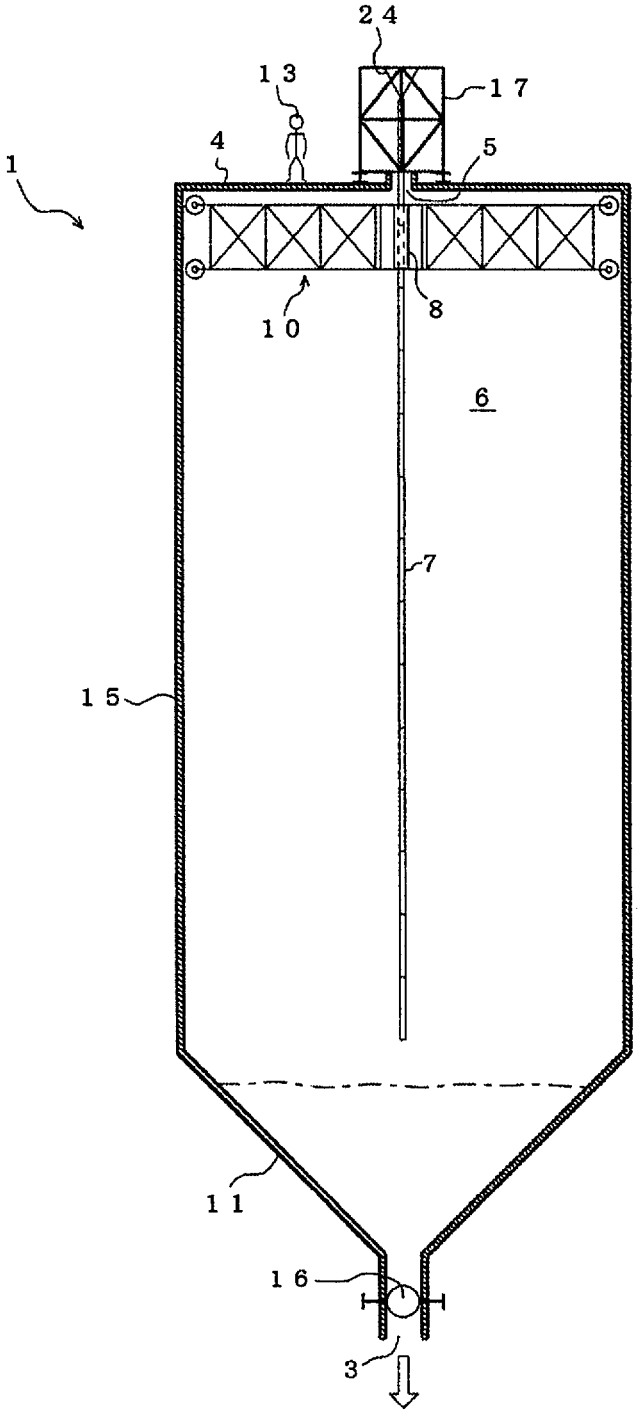
FIG. 20 is a side cross-sectional view of the silo showing the following process.

Then, after the work scaffold 10 is raised to an upper portion in the silo 1, and then the worker 13 comes out of the inlet port 5 to the outside of the silo 1, the opening and closing valve 16 of the outlet port 3 is opened, and then the granular powder 2 stored in the silo bottom portion 11 is completely discharged as shown in FIG. 20. Thus, the granular powder 2 in the fixed state in the silo 1 can be completely poked and broken down and then discharged.

(Disassembling and Removal of Work Scaffold 10)

Figure 21:
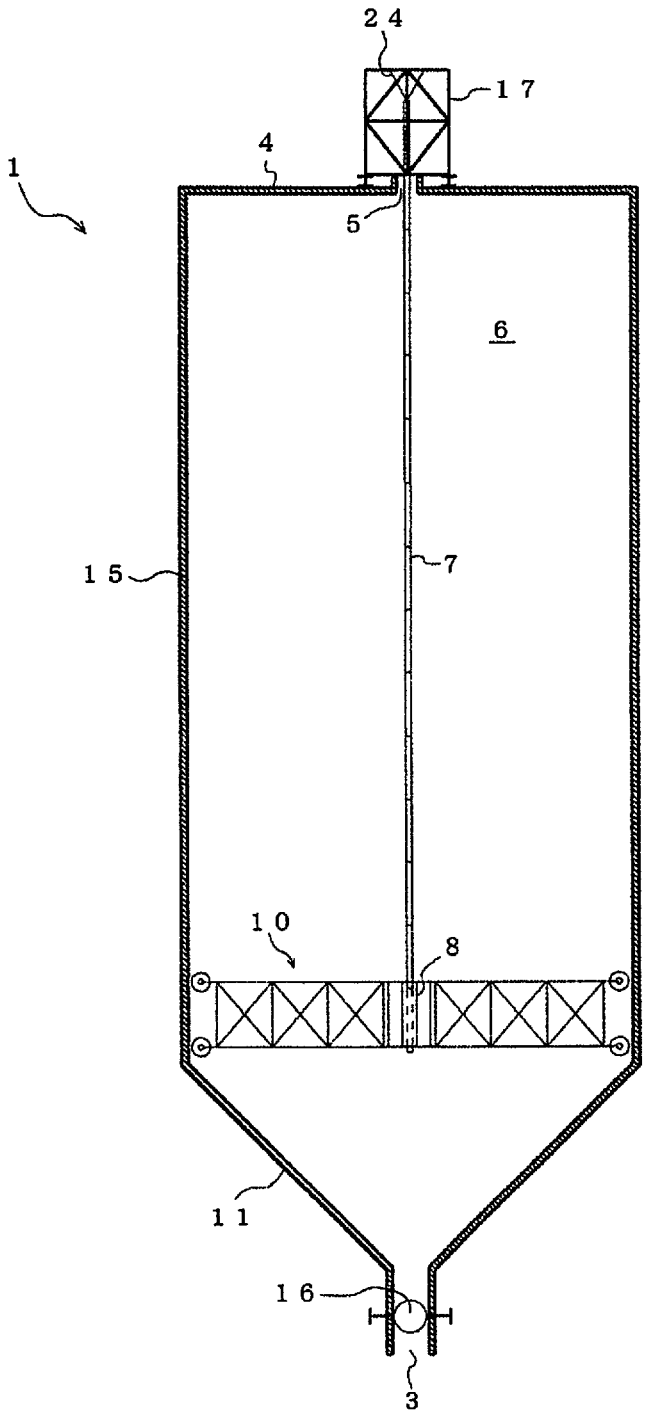
FIG. 21 is a side cross-sectional view of the silo showing the following process.

Thereafter, the work scaffold 10 is towered to the position of the finally added rack rail 7 as shown in FIG. 21. Then, the worker riding on the work scaffold 10 and the worker removing the opening and closing valve 16, and then entering the silo 1 from the outlet port 3 disassemble the work scaffold 10 located in the bottom portion 11 in the silo 1, and then carry out the disassembled parts (radial direction members 28, circumferential direction members 29, floor boards 30, reinforcing members 31, diagonal members 32, and the like) from the outlet port 3 to the outside of the silo 1. Thus the work is completed.

(Operation and Effect)

As described above, according to the method for discharging the granular powder 2 brought into the fixed state inside the hollow structure (silo 1) according to this embodiment, the worker 13 poking and breaking down the granular powder 2 brought into the fixed state in the silo 1 is supported by the work scaffold 10 located above the granular powder 2, and therefore the situation (collapse accident) where the worker 13 is buried in the collapsed granular powder 2 can be prevented.

Moreover, the passage (rat hole, artificial hole) 14 formed in the vertical direction in the granular powder 2 in the fixed state in the silo 1 is utilized not only as a discharge path for the poked and broken down granular powder 2 but as a temporary placing space temporarily storing the poked and broken down granular powder 2. More specifically, the poked and broken down granular powder 2 is dropped to the rat hole (artificial hole) 14 to be temporarily stored in the state where the discharge port 3 of the silo bottom portion 11 is closed, and then the rack rail 7 is added in the state where the rat hole (artificial hole) 14 is blocked with the granular powder 2. Therefore, even when the safety belt 12 temporarily (at the worst) comes off, a situation (fall accident) where the worker 13 falls through the inside of the rat hole (or artificial hole) 14 to the silo bottom portion 11 can be prevented, and the addition work of the rack rail 7 can be performed with high safety.

By repeating the work of adding the next rack rail 7 to the rack rail 7 projecting from below the work scaffold 10, and then lowering the work scaffold 10 to the added rack rail 7, the granular powder 2 in the fixed state in the silo 1 can be gradually poked and broken down from above, and then discharged from the outlet port 3 of the silo bottom portion 11. Finally, the granular powder 2 in the fixed state in the silo 1 can be completely and safely poked and broken down, and then discharged. Therefore, a problem of the logging with granular powders (rat hole, bridge, and the like) can be safely solved.

As described above, although the preferable embodiments of the present invention are described with reference to the accompanying drawings, it is a matter of course that the present invention is not limited to the embodiments described above and various modification examples and alternation examples within the scope of the claims of the present invention also belong to the technical scope of the present invention.

INDUSTRIAL APPLICABILITY

The present invention can be utilized for a method for, when a granular powder stored inside a hollow structure, such as a silo, is brought into a fixed state and cannot be discharged from a discharge port of a bottom portion of the hollow structure, breaking down the granular powder in the fixed state, and then discharging the same from the discharge port.

DESCRIPTION OF NUMERALS

1 silo (hollow structure)
2 granular powder
3 discharge port (outlet port)
4 ceiling portion
5 opening (inlet port)
6 upper space
7 rack rail
8 lifting body
9 part
10 work scaffold
11 silo bottom portions
12 safety belts
13 workers
14 passage (rat hole, artificial hole)

What is claimed is:

1. A method for, when a granular powder stored inside a hollow structure is brought into a fixed state and cannot be discharged from a discharge port of a bottom portion of the hollow structure, breaking down the granular powder in the fixed state, and then discharging the granular powder from the discharge port, the method comprising the steps of:

suspending a rack rail of a predetermined length into an upper space in the hollow structure from an opening formed in a ceiling portion of the hollow structure;

lowering a lifting body moving along the rack rail from the opening to the upper space in the hollow structure along the rack rail;

building a work scaffold so as to project in a horizontal direction on the lifting body in the upper space in the hollow structure using a part carried into the hollow structure from the opening;

poking and breaking down the granular powder in the fixed state under the work scaffold by a worker connected to the work scaffold with a safety belt in a state where the discharge port of the bottom portion of the hollow structure is closed:

dropping the poked and broken down granular powder to a passage formed in the granular powder in the fixed state under the work scaffold from a top surface of the granular powder to the discharge port in the closed state of the bottom portion of the hollow structure;

adding a next rack rail to a lower end of the rack rail under the work scaffold by the worker connected to the work scaffold with the safety belt in a state where the passage is blocked with the poked and broken down granular powder;

opening the discharge port of the bottom portion of the hollow structure to discharge the granular powder stored in the passage; and lowering the lifting body to the added rack rail to lower the work scaffold.

2. The method for discharging a granular powder brought into a fixed state inside a hollow structure according to claim 1, wherein the passage is a rat hole formed in a vertical direction in the granular powder stored in the hollow structure from the top surface of the granular powder to the discharge port of the bottom portion of the hollow structure by fixation and lamination of the granular powder in the hollow structure on an inner surface of the hollow structure and is formed before the method for discharging the granular powder is carried out.

3. The method for discharging a granular powder brought into a fixed state inside a hollow structure according to claim 1, wherein the passage is an artificial hole formed in the vertical direction by boring in the granular powder brought into the fixed state in the hollow structure and is formed before the step of poking and breaking down the granular powder in the fixed state under the work scaffold by the worker connected to the work scaffold with the safety belt.

4. The method for discharging a granular powder brought into a fixed state inside a hollow structure according to claim 1, wherein the step of suspending the rack rail of a predetermined length into the upper space in the hollow structure from the opening formed in the ceiling portion of the hollow structure includes repeating steps of temporarily placing the lifting body in the opening, inserting the rack rail into the lifting body from above, driving a pinion provided inside the lifting body to send out the inserted rack rail below the lifting body, stopping the sending-out once in a state where an upper end of the rack rail while being sent out projects from an upper portion of the lifting body, adding a next rack rail to the upper end of the rack rail projecting from the upper portion of the lifting body, and sending out the added rack rail below the lifting body.

5. The method for discharging a granular powder brought into a fixed state inside a hollow structure according to claim 4, wherein the step of lowering the lifting body moving along the rack rail from the opening to the upper space in the hollow structure along the rack rail includes supporting the upper end of the rack rail projecting upward from the lifting body temporarily placed in the opening on a mount provided on the ceiling portion of the hollow structure, releasing the temporal placement to the opening of the lifting body, and driving the pinion provided inside the lifting body in a direction opposite to a direction when sending out the rack rail downward to thereby lower the lifting body along the rack rail from the opening.

* * * * *